US005995069A

United States Patent [19]

Tokunaga et al.

[11] Patent Number: 5,995,069

[45] Date of Patent: Nov. 30, 1999

[54] DRIVING SYSTEM FOR A PLASMA DISPLAY PANEL

[75] Inventors: Tsutomu Tokunaga; Nobuhiko Saegusa, both of Yamanashi-ken, Japan

[73] Assignee: Pioneer Electronic Corporation, Tokyo, Japan

[21] Appl. No.: 08/941,484

[22] Filed: Oct. 1, 1997

[30] Foreign Application Priority Data

Oct. 4, 1996 [JP] Japan ..... 8-283179
May 1, 1997 [JP] Japan ..... 9-113995

[51] Int. Cl.[6] ..... G09G 3/28

[52] U.S. Cl. ..... 345/60; 345/208; 315/169.4

[58] Field of Search ..... 345/60, 61, 62, 345/63, 64, 65, 66, 67, 68, 69, 70, 204, 208, 209, 210; 315/169.4, 169.1

[56] References Cited

U.S. PATENT DOCUMENTS 5,854,540 12/1998 Matsumoto et al. ..... 345/204

*Primary Examiner*—Xiao Wu
*Attorney, Agent, or Firm*—Nikaido, Marmelstein, Murray & Oram LLP

[57] ABSTRACT

A plasma display panel has a plurality of pairs of row electrodes, each pair comprising a first row electrode and a second row electrode, and a plurality of data electrodes which intersect with the row electrodes. A first row electrode driver having driving circuit means is provided for driving each of the first row electrodes, and a second row electrode driver is provided for driving each of the second row electrodes. A driving power source is provided for driving the driving circuit means in the first row electrode driver, and an offset voltage applying means is provided for applying an offset voltage to the driving power source so that the first row electrode driver produces a first priming pulse having a first voltage which is applied to the first row electrode. A scanning pulse is produced after the priming pulse having a second voltage different from the first voltage, which is also applied to the first row electrode.

9 Claims, 16 Drawing Sheets

DRIVING SYSTEM FOR A PLASMA DISPLAY PANEL

BACKGROUND OF THE INVENTION

The present invention relates to a driving system for driving a plasma display panel (PDP) of a matrix display type.

The applicant of the present invention submitted a driving method for a PDP disclosed in Japanese Patent Application No. 7-90977. In the method, an address margin is largely improved, thereby obtaining an accurate luminous display without error discharge.

FIG. 14 shows a display system in the prior art. The display system comprises a sync signal separation circuit 1 applied with a video signal for extracting horizontal and vertical synchronizing signals. The horizontal and vertical synchronizing signals are applied to a timing pulse generating circuit 2 which produces various timing pulses based on the synchronizing signals. The timing pulses are applied to an A/D converter 3, a memory control circuit 5, and a read-out timing pulse generating circuit 7.

The A/D converter 3 is further applied with the video signal and operated to convert the input video signal into a digital pixel data signal for each pixel in synchronism with the timing pulse. The digital pixel data signal is applied to a frame memory 4.

The memory control circuit 5 produces a writing signal and a reading signal in synchronism with the timing pulse. The writing and reading signals are applied to the frame memory 4. The frame memory 4 is operated to store the pixel data from the A/D converter 3 in order in response to the writing signal, and to read the pixel data stored therein in order in response to the reading signal. The read pixel data is applied to an output processing circuit 6.

The read-out timing pulse generating circuit 7 generates various read-out timing pulses for controlling the discharge and emission of light. The read-out timing pulses are applied to a row electrode driver 10 and the output processing circuit 6. The output processing circuit 6 applies the pixel data from the frame memory 4 to a pixel data electrode driver 12 in synchronism with the read-out timing pulse.

The pixel data electrode driver 12 is connected to pixel data electrodes D1, D2, D3, . . . Dm−1, and Dm of a plasma display panel (PDP) 11. The pixel data electrode driver 12 produces a pixel data pulse DP corresponding to the pixel data from the output processing circuit 6 and applies the pixel data pulse DP to the pixel data electrodes D1–Dm for driving the pixel data electrodes.

The row electrode driver 10 is connected to a series of row electrodes X1, X2, X3, . . . Xn and another series of row electrodes Y1, Y2, Y3, . . . Yn of the PDP 11. The row electrode driver 10 produces reset pulses RPx and RPy for forcibly exciting to discharge a pair of row electrodes X and Y for producing charged particles in a discharge space, which will be described hereinafter, a priming pulse PP for reproducing the charged particle, a scanning pulse SP for writing the pixel data, sustaining pulses IPx and IPy for sustaining the discharge and emission of light, and an erasing pulse EP for erasing wall charge. These pulses are applied to the row electrodes X1–Xn and Y1–Yn of the PDP 11 at the respective timings corresponding to the read-out timing pulses from the read-out timing pulse generating circuit 7.

FIG. 15 shows the PDP 11. The PDP 11 comprises a front glass substrate 110 as a display portion. On the front substrate 110, the row electrodes X1–Xn and Y1–Yn are alternately formed in pairs at the inside portion thereof which corresponds to a rear glass substrate 113. The row electrodes are covered by a dielectric layer 111. An MgO (magnesia) layer 112 is deposited on the dielectric layer 111 by vacuum deposition. Between the MgO layer 112 and the rear substrate 113, a discharge space 114 is formed. The pixel data electrodes D1–Dm coated with phosphor are formed on the inside portion of the rear substrate 113 to intersect the row electrodes X and Y of the front substrate 110.

A pair of row electrodes X and Y form one row of an image. At the intersection of each of the pixel data electrodes Dj (j=1,2,3, . . . m) and each pair of row electrodes Xi and Yi (i=1,2,3, . . . n), a pixel Pi,j is formed (FIG. 14).

Operation of the PDP 11 will be described. FIG. 16 shows a timing chart of drive signals for driving the PDP.

The row electrode driver 10 applies a first reset pulse RPx of positive voltage to each of the row electrodes X1–Xn and a second reset pulse RPy of negative voltage to each of the row electrodes Y1–Yn. Thus, the row electrodes in pairs are excited to discharge, thereby producing charged particles in the discharge space 114 at the pixel Pi,j. Thereafter, when the discharge is finished, a predetermined amount of wall charge is uniformly formed on the dielectric layer 111 at the pixel Pi,j (A reset period all at once).

The pixel data electrode driver 12 applies pixel data pulses DP1–DPn of positive voltage corresponding to the pixel data for every row to the pixel data electrodes D1–Dm in order.

At that time, the row electrode driver 10 applies the scanning pulses SP each of which has a small width to the row electrodes Y1–Yn in order in synchronism with the timings of the data pulse DP1–DPn. The driver 10 further applies the priming pulses PP of positive voltage to the row electrodes Y1–Yn, immediately before the scanning pulses SP.

In the discharge space 114, the charged particles obtained by the operation of reset all at once are reduced as the time passes. Therefore, the priming pulse PP is applied to the row electrodes for reproducing the charged particles in the discharge space 114.

The writing of the pixel data is performed in accordance with the scanning pulse SP in existence of the charged particles. For example, when the logic value of the pixel data is "0", the scanning pulse SP and the pixel data pulse DP are simultaneously applied, so that the wall charge produced in the pixel is disappeared. On the other hand, when the logic value of the pixel data is "1", only the scanning pulse SP is applied, so that the discharge does not occur. Thus, the wall charge in the pixel is held, thereby emitting light. Namely, the scanning pulse SP is a selecting and erasing pulse for selectively erasing the wall charge as a trigger in accordance with the pixel data (An address period).

The row electrode driver 10 continuously applies the sustaining pulse IPx of positive voltage to the row electrodes X1–Xn and the sustaining pulse IPy of positive voltage to the row electrodes Y1–Yn at offset timing from the sustaining pulses IPx. During the sustaining pulses are applied, the pixel which hold the wall charge sustains the discharge and emission of light (A discharge sustaining period).

Then, the driver 10 applies the erasing pulses EP to the row electrodes Y1–Yn, thereby erasing the wall charge (A wall charge erasing period).

From the foregoing, in the display system, the reset pulses are applied to the row electrodes to reset them all at once.

Thereafter, the priming pulse and the scanning pulse are sequentially applied to the row electrodes for reproducing the charged particles in the discharge space 114 and writing the pixel data for every row.

Thus, the time for operating every row is equal at a high speed. Furthermore, since the pixel data is written in every row in accordance with the scanning pulse SP during the charged particles exist in the discharge space 114. The writing of the pixel data is accurately performed.

As shown in FIG. 16, the priming pulse PP of the positive voltage and the scanning pulse SP of the negative voltage are applied to the row electrode Y.

However, in the system, two pulses having a different polarity are scanned in the row electrodes in pairs. If an all-purpose IC for driving the row electrode driver 10 is used as the row electrode driver, only one pulse having a single polarity can be scanned. The all-purpose IC for scanning two different pulses has not been known at present.

In order to obtain a display having a high definition, the number of row electrodes and the number of tones must be increased, and a scanning rate (address writing cycle) must be reduced. For example, if a display having 1000 rows and 256 tones (8-bit pixel data) is obtained such as a high definition television (HDTV), the scanning rate is about 2 $\mu$s (microsecond: $10^{-6}$ seconds). Such a system is liable to produce error discharge. As a result, it is difficult to stabilize a display operation.

SUMMARY OF THE INVENTION

An object of the present invention is to provide a driving system for a plasma display panel in which an inexpensive all-purpose IC can be used.

Another object of the present invention is to provide a driving system where a stable high definition and high quality display can be obtained without error discharge.

According to the present invention, there is provided a driving system for a plasma display panel having a plurality of pairs of row electrodes, each pair comprising a first row electrode and a second row electrode, and a plurality of data electrodes which intersect with the row electrodes, the system comprising a first row electrode driver having driving circuit means for driving each of the first row electrodes, a second row electrode driver for driving each of the second row electrodes, a driving power source for driving the driving circuit means in the first row electrode driver, an offset voltage applying means for applying an offset voltage to the driving power source so that the first row electrode driver produces a first priming pulse having a first voltage which is applied to the first row electrode, switching means provided in the first row electrode driver for producing a scanning pulse after the priming pulse having a second voltage different from the first voltage, which is also applied to the first row electrode.

The offset voltage applying means has a first power source and a second power source having a supply voltage different from that of the first power source, and switches for changing the offset voltage into two voltages, thereby modulating the offset voltage.

The second row electrode driver produces a second priming pulse having an opposite polarity to the first priming pulse produced by the first row electrode driver at the same time as the first priming pulse.

The first row electrodes may be divided into two groups, the first row electrode driver is arranged such that a period of a scanning pulse for one of the groups is overlapped with a period of a priming pulse for the other group.

The first row electrode driver is divided into a first group driver and a second group driver, the driving power source is divided into a first source for driving the first group driver and a second source for driving the second group driver, the offset voltage applying means is divided into a first means for applying a first offset voltage to the first source and a second means for applying a second offset voltage to the second source, each of the first group driver and the second group driver is arranged so as to produce a priming pulse and a scanning pulse having an opposite polarity to the priming pulse.

These and other objects and features of the present invention will become more apparent from the following detailed description with reference to the accompanying drawings.

BRIEF DESCRIPTION OF DRAWINGS

FIGS. 5*a* to 51 are time charts showing drive signals of the driving system of the second embodiment;

FIGS. 6*a* to 6*j* are time charts showing drive signals of a third embodiment of the present invention;

FIGS. 7*a* to 7*j* are time charts showing drive signals of a fourth embodiment of the present invention;

FIG. 8 is a diagram showing a driving system of a fifth embodiment of the present invention;

FIGS. 9*a* to 9*j* are time charts showing drive signals of the fifth embodiment;

FIG. 10 is a diagram showing a driving system of a sixth embodiment of the present invention;

FIG. 11 is a diagram showing a driving system of a seventh embodiment of the present invention;

FIGS. 12*a* to 12*e* are time charts showing drive signals of an eight embodiment of the present invention;

FIGS. 13*a* to 13*e* are time charts showing drive signals of a ninth embodiment of the present invention;

FIG. 14 is a block diagram showing a display system for a conventional plasma display panel;

FIG. 15 is a schematic perspective view of the conventional plasma display panel; and FIG. 16 is time charts showing drive signals of the conventional system.

DETAILED DESCRIPTION OF THE PREFERRED EMBODIMENTS

Figure 1:
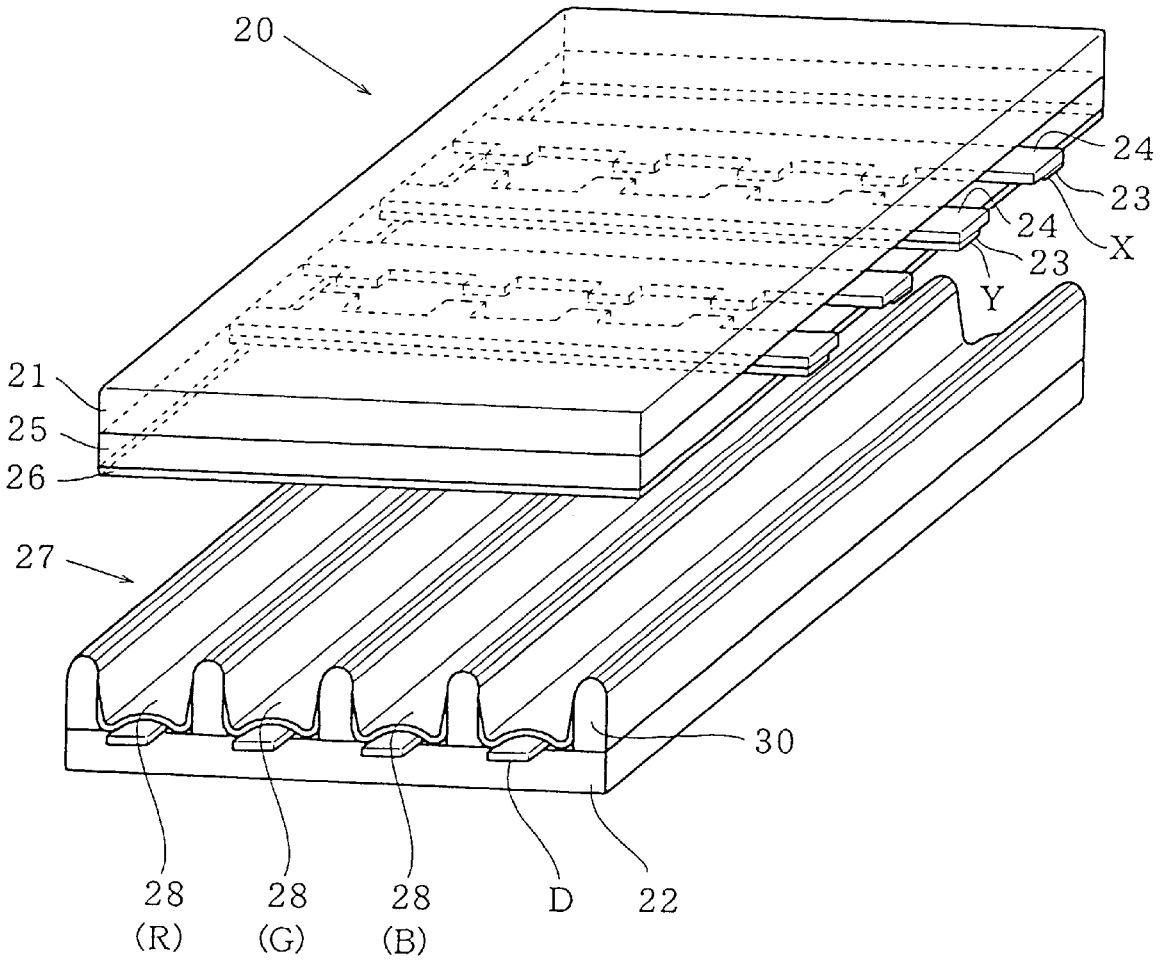
FIG. 1 is a schematic perspective view showing a plasma display panel according to the present invention.

Referring to FIG. 1 showing an ACPDP of a reflection type of three-electrode according to the present invention, an ACPDP 20 comprises a pair of glass substrates 21 and 22 disposed opposite to each other, interposing a discharge space 27 therebetween. The glass substrate 21 as a display portion has row electrodes (sustain electrodes) X and Y which are alternately disposed in pairs to be parallel with each other at the inside portion thereof. The row electrodes X and Y are covered by a dielectric layer 25 for producing wall charge. A protection layer 26 made of MgO is coated on the dielectric layer 25. Each of the row electrodes X and Y comprises a transparent electrode 24 formed by a transparent conductive film having a large width and a bass electrode (metallic electrode) 23 formed by a metallic film having a small width and layered on the transparent electrode 24.

On the glass substrate 22 as a rear member, a plurality of elongated barriers 30 are provided at the inside portion thereof for defining the discharge space 27. The barrier 30 extends in the direction perpendicular to the row electrodes X, Y. Between the barriers 30, data electrodes D are formed to intersect the row electrodes X and Y of the glass substrate 21. A phosphor layer 28 having a predetermined luminous color R, G or B covers each of the data electrodes D and opposite side portions of the barrier 30. The discharge space 27 is filled with discharge gas consisting of neon mixed with xenon. Thus, a pixel is formed at the intersection of the row electrodes in pairs and the data electrode.

Figure 2:
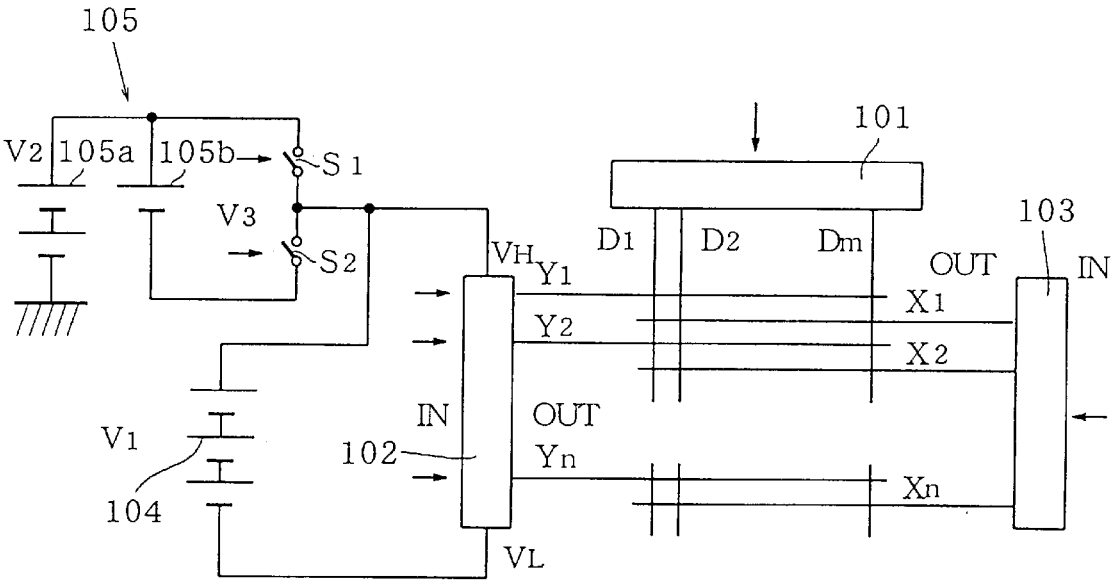
FIG. 2 is a diagram showing a driving system for the plasma display panel.

Referring to FIG. 2 showing a driving system for driving the PDP 20, the driving system comprises a pixel data electrode (address) driver 101 connected to pixel data electrodes D1–Dm, and a pair of row electrode drivers 102 and 103. A Y-row electrode driver 102 is connected to a series of row electrodes Y1–Yn. An X-row electrode driver 103 is connected to another series of the row electrodes X1–Xn.

The data electrode driver 101 applies a pixel data pulse to each of the data electrodes D1–Dm for driving the data electrode.

The Y-row electrode driver 102 comprises an all-purpose scanning driver IC for scanning only one pulse having a single polarity. The Y-row electrode driver 102 produces the reset pulse RPy for forcibly exciting the discharge between the Y-row electrodes, thereby producing a reset pulse RPy for generating charged particles in the discharge space, priming pulse PP for reproducing the charged particle, scanning pulse SP for writing the pixel data, sustaining pulse IPy for sustaining the discharge and emission of light, and erasing pulse EP for erasing the charge. These pulses are applied to the row electrodes Y1–Yn corresponding to the input timing pulses for driving the Y-row electrodes.

The X-row electrode driver 103 also comprises the all-purpose scanning driver IC for scanning only one pulse having a single polarity. The X-row electrode driver 103 produces the reset pulse RPx for forcibly exciting the discharge of the X-row electrodes for producing charged particles in the discharge space, and a sustaining pulse IPx for sustaining the discharge and emission of light. The pulses are applied to the row electrodes X1–Xn corresponding to input timing pulses for driving the X-row electrodes.

The driving system further has a first power source 104 and an offset power source 105. The first power source 104 is a floating power source of voltage V1. The offset power source 105 comprises a second power source 105*a* of voltage V2 and a third power source of voltage V3, and a first switching element S1 and a second switching element S2 connected to each other in series. The offset power source 105 produces an offset voltage in accordance with switching operations of the switching elements S1 and S2, which will be described hereinafter.

A positive pole of the first power source 104 is connected to a high level terminal VH of the Y-row electrode driver 102 and a negative pole of the power source 104 is connected to a low level terminal VL of the driver 102. A negative pole of the second power source 105*a* is connected to the ground to be a ground potential, and a positive pole of the second power source 105*a* is connected to a positive pole of the third power source 105*b* which is in turn connected to a fixed contact of the first switching element S1. A negative pole of the third power source 105*b* is connected to a movable contact of the second switching element S2. A movable contact of the first switching element S1 is connected to a fixed contact of the second switching element S2. Between the movable contact of the first switching element S1 and the fixed contact of the second switching element S2, the positive pole of the first power source 104 is connected.

Operation for driving the PDP 20 will be described with reference to the time charts of drive signals of FIGS. 3*a* to 3*j*.

Figure 3:
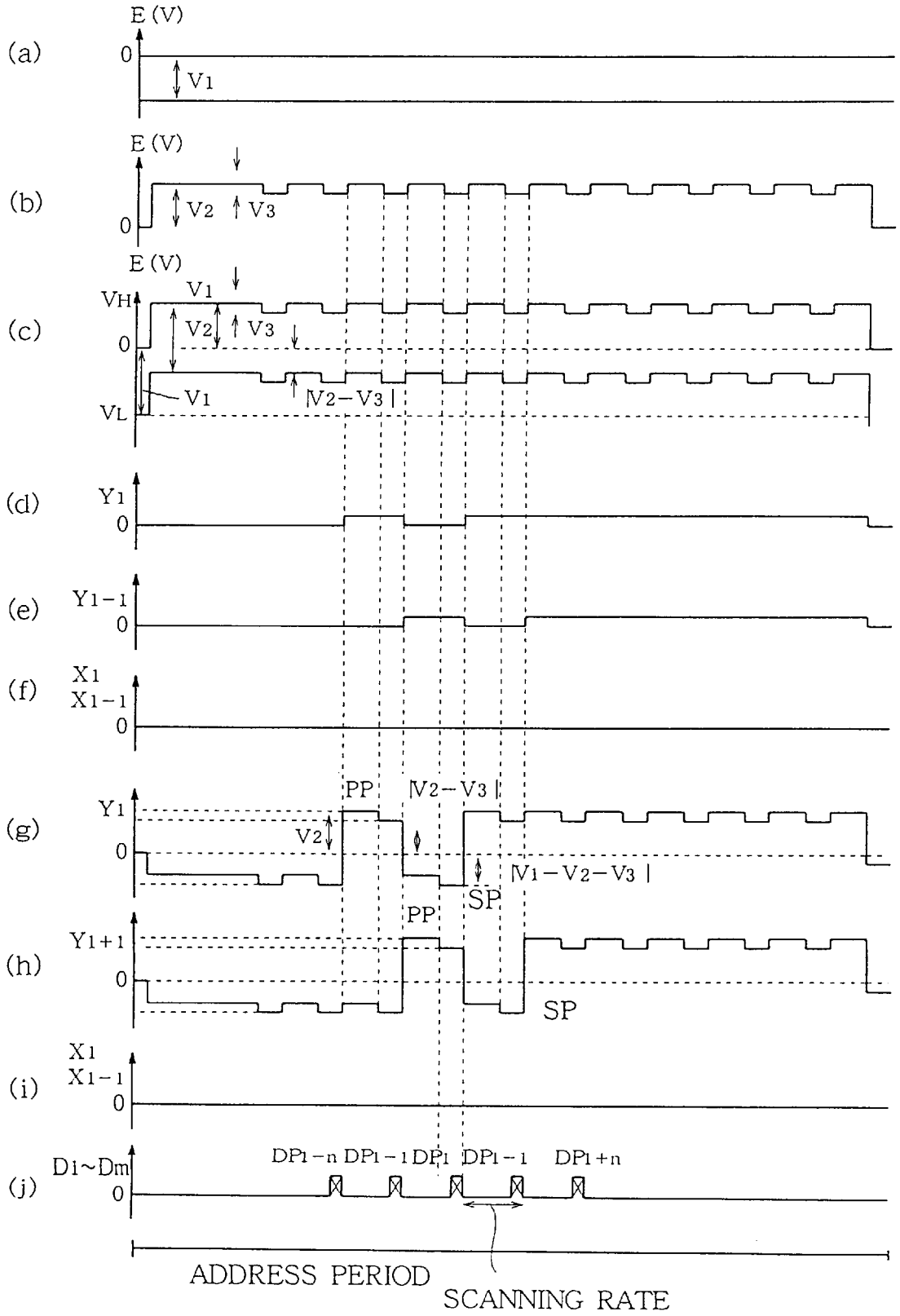
FIGS. 3*a* to 3*j* are time charts showing drive signals of the driving system.

FIG. 3*a* is a source voltage of the first power source 104. During an address period, the first and second switching element S1 and S2 are alternately opened and closed at a predetermined interval in accordance with an input added pulse. Thus, the offset power source 105 produces the offset voltage which is modulated by the added pulse as shown in FIG. 3*b*. When the first switching element S1 is closed and the second switching element S2 is opened, the offset voltage is V2. When the first switching element S1 is opened and the second switching element S2 is closed, the offset voltage becomes V2−V3.

The offset voltage is applied to the positive pole of the first power source 104. As a result, the high and low level terminals VH and VL of the row electrode driver 102 are applied with voltage as shown in FIG. 3*c*. Namely, when the offset voltage V2 is applied to the high level terminal VH of the row electrode driver 102 (VH=V2), the low level terminal VL of the driver 102 becomes V2−V1 (VL=V2−V1). When the offset voltage V2−V3 is applied to the high level terminal VH of the driver 102 (VH=V2−V3), the low level terminal VL of the driver 102 becomes V2−V1−V3 (VL=V2−V1−V3).

FIGS. 3*d* and 3*e* show timing signals for producing priming pulse and scanning pulse, respectively. When timing pulses are applied to the row electrode driver 102 in synchronism with the added pulse, switching elements (not shown) provided in the driver 102 are operated. Thus, the priming pulse PP and the inverted scanning pulse SP which are offset to the negative polarity are produced and applied to the row electrodes Yi and Yi+1, respectively as shown in FIGS. 3*g* and 3*h*. An electric potential of the priming pulse PP from the ground potential is V2, and an electric potential of the scanning pulse SP from the ground potential is V2−V1−V3.

As shown in FIG. 3*j*, the pixel data pulse DP is applied to the data electrodes D1–Dm corresponding to the scanning pulse SP.

After the scanning pulse SP is applied, a predetermined positive voltage (V2 or V2−V3) is applied to the row electrodes Y1–Yn during the address period. Thus, error discharge caused by scanning the other row electrodes is prevented.

As shown in FIGS. 3*f* and 3*i*, since an input signal is not applied to the X-row electrode driver 103 during the address period, the row electrodes X1–Xn maintain the ground potential.

In accordance with the present invention, it is possible to produce two pulses (priming pulse and scanning pulse) having a different polarity by using the all-purpose IC.

Figure 4:
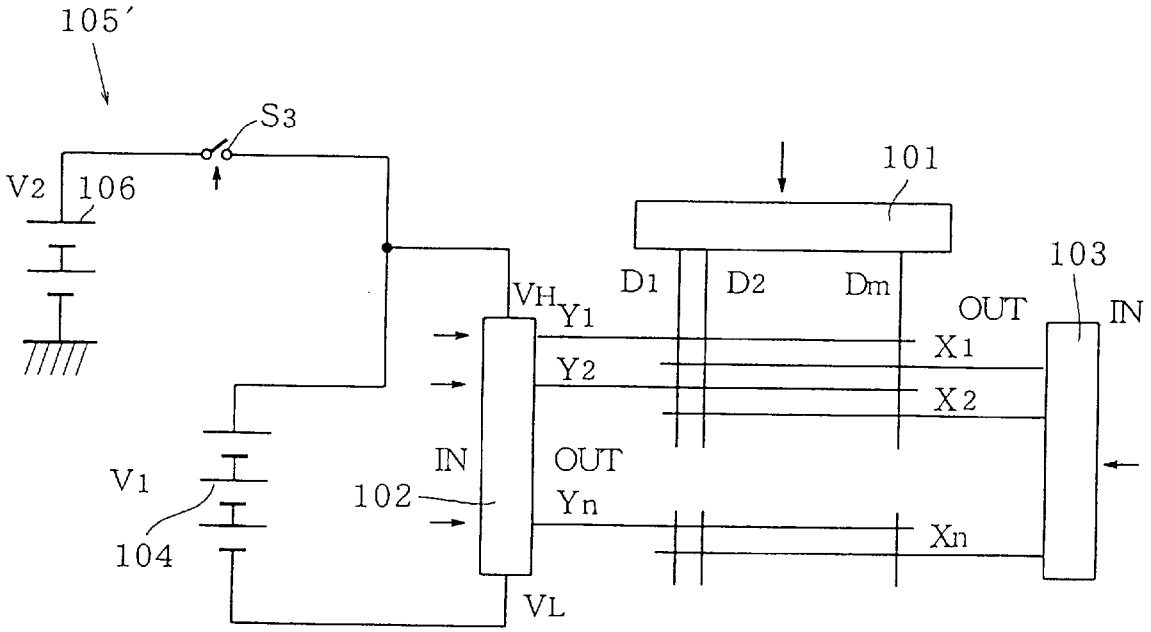
FIG. 4 is a diagram showing a second embodiment of the driving system for the plasma display panel according to the present invention.

FIG. 4 shows a second embodiment of the driving system. The driving system comprises the data electrode driver 101 for driving the data electrode D1–Dm, the row electrode drivers 102 and 103 for driving the row electrodes Y1–Yn and X1–Xn, respectively, the first power source 104 of the voltage V1, and an offset power source 105'. The drivers 101, 102 and 103, and the power source 104 are the same as those of the first embodiment of FIG. 2, and detailed descriptions thereof are omitted.

The offset power source 105' for producing offset voltage comprises a second power source 106 of voltage V2 and a switching element S3. A negative pole of the second power source 106 is connected to the ground to be ground potential, and a positive pole of the second power source 106 is connected to a movable contact of the switching element S3. A fixed contact of the switching element S3 is connected to the positive pole of the first power source 104.

The driving operation of the second embodiment will be described with reference to the time charts of FIGS. 5*a* to 5*l*.

Figure 5:
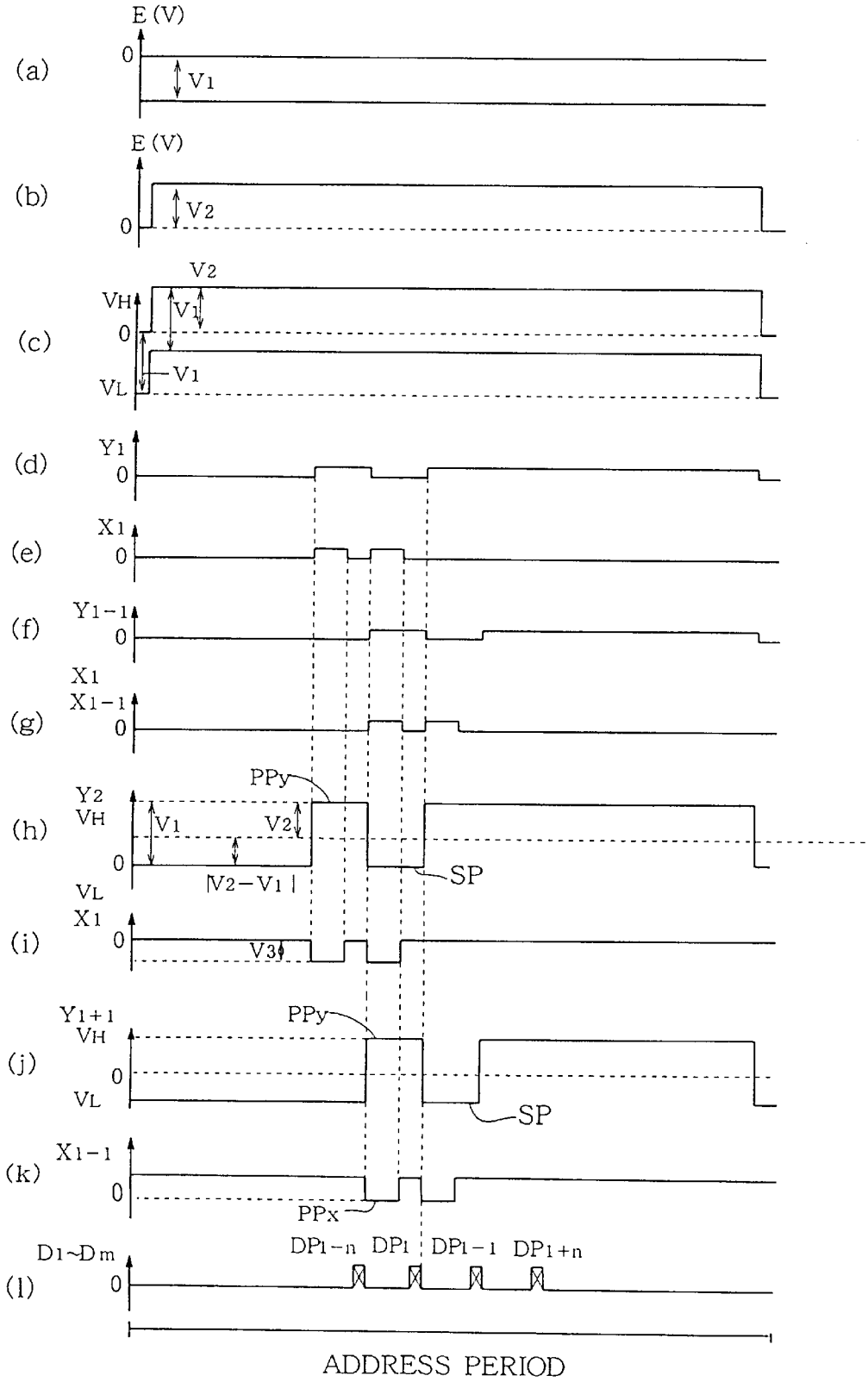

FIG. 5*a* is the source voltage of the first power source 104. During the address period, the switching element S3 is closed so that the offset power source 105' produces the offset voltage V2 as shown in FIG. 5*b*. The offset voltage V2 is applied to the first power source 104 which applies voltage to the Y-row electrode driver 102 as shown in FIG. 5*c*. Namely, the high level terminal VH of the row electrode driver 102 becomes V2 (VH=V2), and the low level terminal VL of the driver 102 becomes V2−V1 (VL=V2−V1).

When the timing pulses shown in FIGS. 5*d* and 5*f* are applied to the row electrode driver 102, the driver 102 produces the priming pulse PPy and the scanning pulse SP in accordance with on-off operaitons of the switching elements provided therein. The priming pulse PPy and the scanning pulse SP which are offset to the negative polarity are applied to the row electrodes Yi and Yi+1, respectively as shown in FIGS. 5*h* and 5*j*. An electric potential of the priming pulse PPy from the ground potential is V2, and an electric potential of the scanning pulse SP from the ground potential is V2−V1.

As shown in FIG. 5l, the pixel data pulse DP is applied to the data electrodes D1–Dm corresponding to the scanning pulse SP.

On the other hand, when the timing pulse shown in FIGS. 5*e* and 5*g* are applied to the X-row electrode driver 103 for producing a priming pulse PPx, switching elements (not shown) provided in the driver 103 are operated. Thus, the driver 103 applies the priming pulse PPx which is offset to the negative polarity to the row electrodes Xi and Xi+1, respectively, as shown in FIGS. 5*i* and 5*k*, corresponding to the priming pulse PPy.

After the scanning pulse SP is applied, a predetermined positive voltage (V2) is applied to the row electrodes Y1–Yn during the address period. Thus, error discharge caused by scanning the other row electrodes is prevented.

In the second embodiment, it is possible to obtain the same effects as the first embodiment.

FIGS. 6*a* to 6*j* show time charts of drive signals for a third embodiment of the present invention. A driving system of the third embodiment is the same as that shown in FIG. 4.

Figure 6:
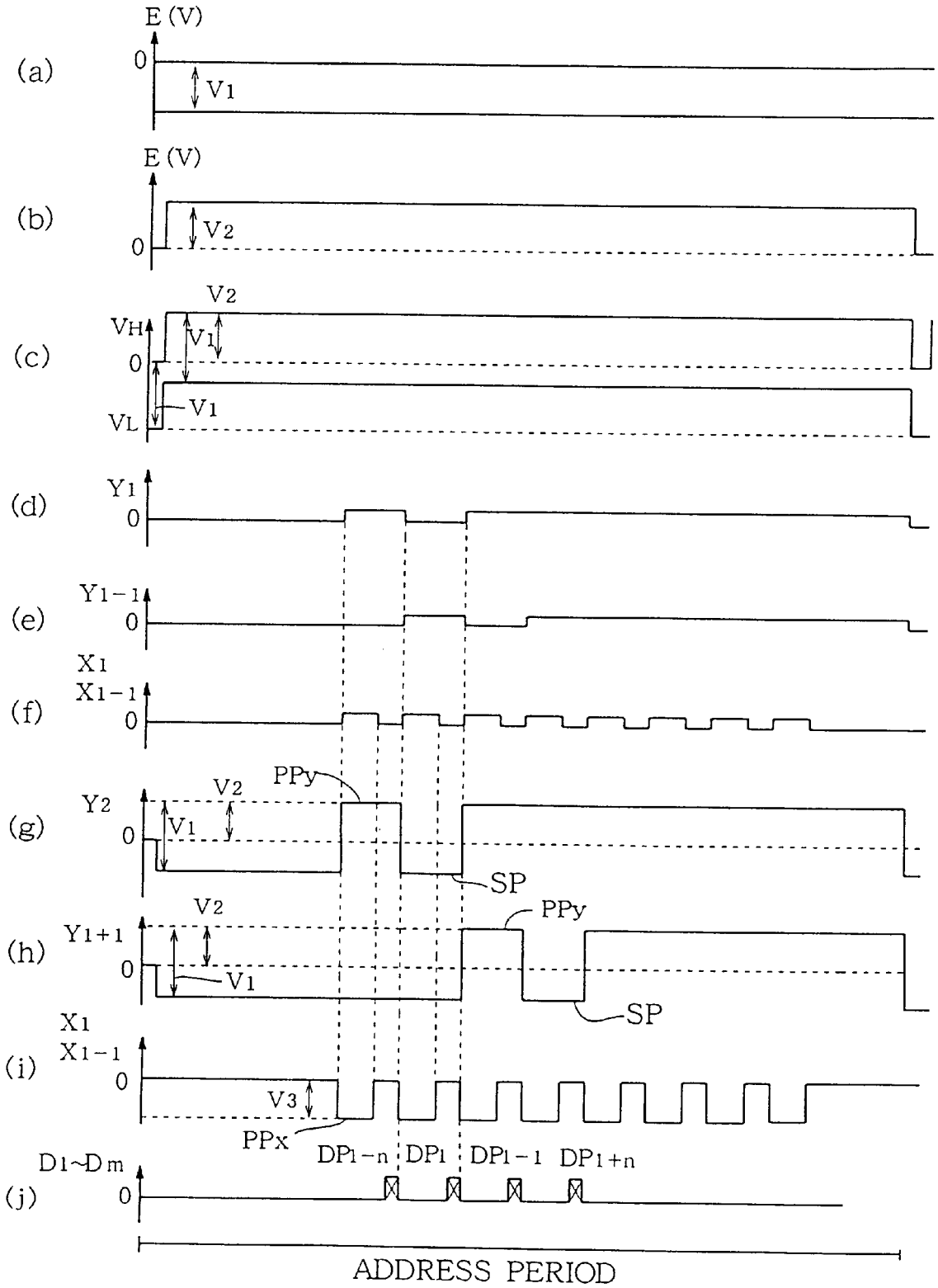

The drive signals shown in FIGS. 6*a* to 6*c* are the same as those shown in FIGS. 5*a* to 5*c* of the second as embodiment. Namely, FIG. 6*a* is the voltage of the first power source 104, FIG. 6*b* is the voltage of the second power source 106, and FIG. 6*c* is the voltage applied to the high and low level terminals of the Y-row electrode driver 102.

FIGS. 6*d* and 6*e* are timing pulses applied to the row electrode driver 102 for producing the priming pulse PPy and the scanning pulse SP. FIG. 6*f* is a timing pulse applied to the X-row electrode driver 103 for producing the priming pulse PPx. FIGS. 6*g* and 6*h* are the priming pulse PPy and the scanning pulse SP applied from the driver 102 to the row electrodes Yi and Yi+1. FIG. 6*i* is the priming pulse PPx applied from the driver 103 to the row electrodes Xi and Xi+1. FIG. 6*j* is the adata pulse DP applied to the data electrodes D1–Dm.

In the third embodiment, the priming pulse PPx is not scanned, but the same priming pulse PPx is applied to the row electrodes X1–Xn. Thus, the control of the X-row electrode driver 103 can be simplified.

FIGS. 7*a* to 7*j* show time charts of drive signals for a fourth embodiment of the present invention. A driving system of the fourth embodiment is the same as that shown in FIG. 4.

The drive signals shown in FIGS. 7*a* to 7*j* correspond to those shown in FIGS. 6*a* to 6*j* of the third embodiment.

Figure 7:
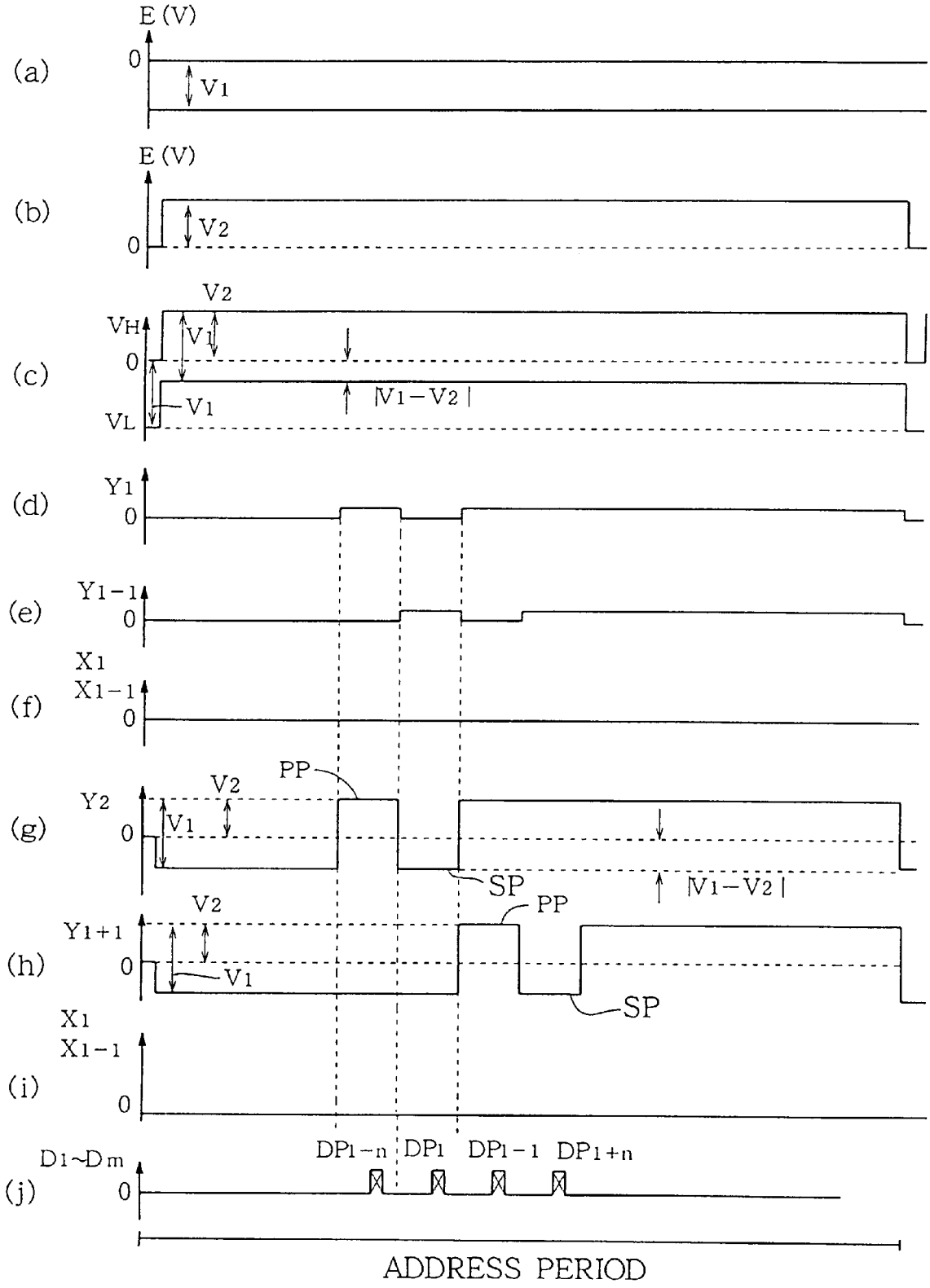

However, as shown in FIGS. 7*f* and 7*i* , the timing signal is not produced and the priming pulse PPx is not applied to the row electrodes X1–Xn of the X-row electrode driver 103. Thus, as described in the second embodiment, the row electrodes X1–Xn maintain the ground potential.

In the fourth embodiment, the control of the X-row electrode driver 103 can be simplified.

Figure 8:
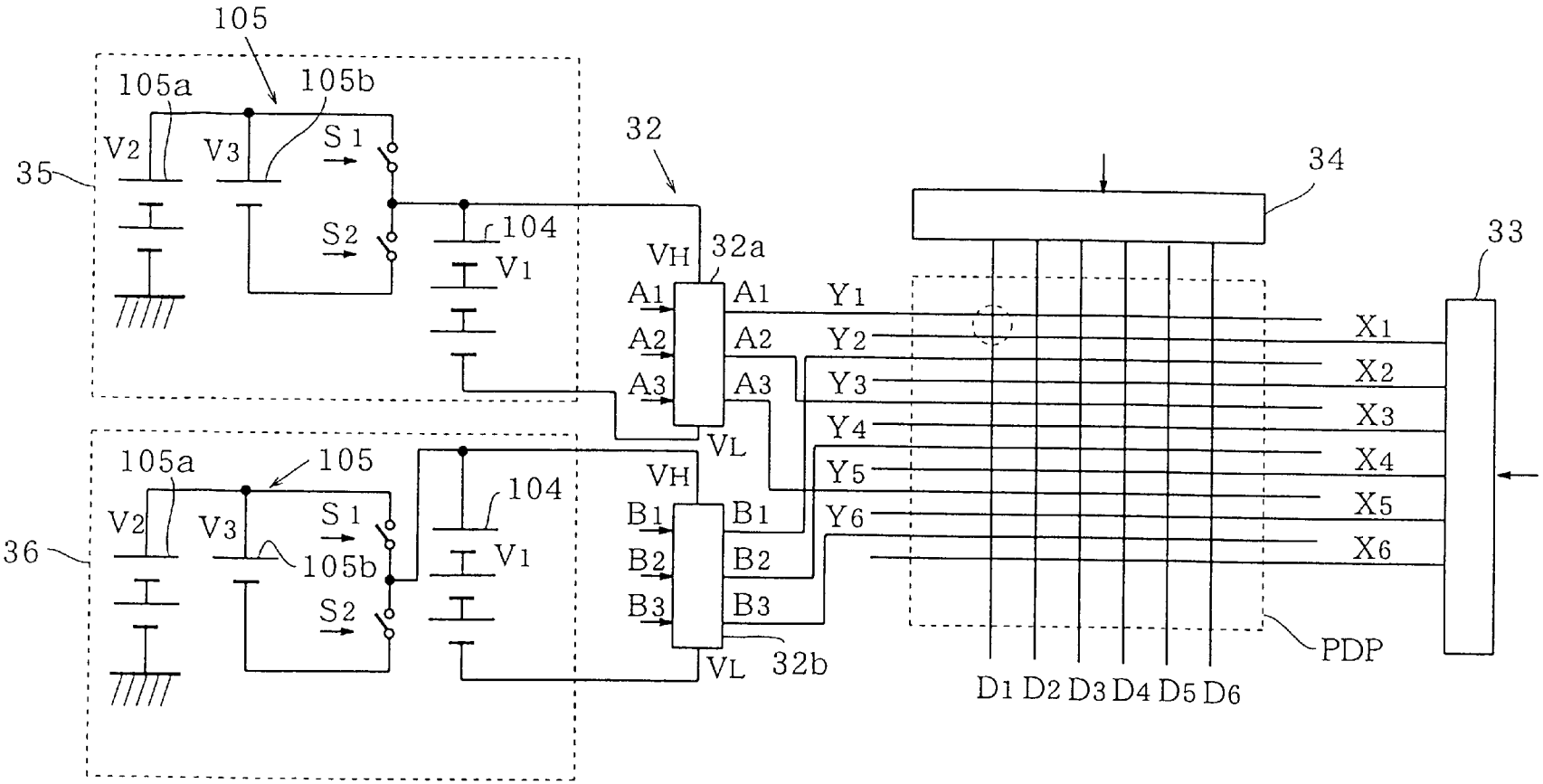

FIG. 8 shows a fifth embodiment of the present invention. A PDP comprises 6 row electrodes and 6 data electrodes to form 36 pixels.

A driving system comprises a pixel data electrode (address) driver 34 for driving six data electrode D1–D6, and a Y-row electrode driver 32 having a pair of row electrode drivers 32*a* and 32*b* for driving six Y-row electrodes (scanning row electrodes) Y1–Y6, and an X-row electrode driver 33 for driving six X-row electrodes X1–X6.

The pixel data electrode driver 34 applies pixel data pulses DP1–DP6 to the data electrodes D1–D6. One of the Y-row electrode drivers 32*a* is connected to the row electrodes Y1, Y3 and Y5, and the other Y-row electrode driver 32*b* is connected to the row electrodes Y2, Y4 and Y6.

Each of the Y-row electrode drivers 32*a* and 32*b* comprises all-purpose scanning driver IC for scanning only one pulse having a single polarity. The Y-row electrode drivers produce the reset pulses RPy, priming pulses PP, scanning pulses SP, sustaining pulses IPy, and erasing pulse EP. These pulses are applied to the row electrodes Y–Y6 corresponding to the input timing pulses.

The X-row electrode driver 33 also comprises the all-purpose scanning driver IC for scanning only one pulse having a single polarity, and produces reset pulse RPx and sustaining pulse IPx which are applied to the row electrodes X1–X6 corresponding to input timing pulses.

The driving system further has a pair of power sources 35 and 36 for applying voltage to Y-row electrode drivers 32*a* and 32*b* , respectively. Each of the power sources 35, 36 is the same as that shown in the first embodiment of FIG. 2. Namely, the power source comprises first power source 104 and offset power source 105 having second power source 105*a* and third power source 105*b*, first switching element S1 and second switching element S2. Therefore, detailed descriptions of structures and operations thereof are omitted.

In the switching elements S1 and S2 of the power sources 35 and 36, the timing of the added pulse applied to the switching elements S1 and S2 of the power source 35 is offset to that applied to the switching elements S1 and S2 of the power source 36 by a half interval.

Operation of the fifth embodiment will be described with reference to FIGS. 9*a* to 9*h*.

Figure 16:
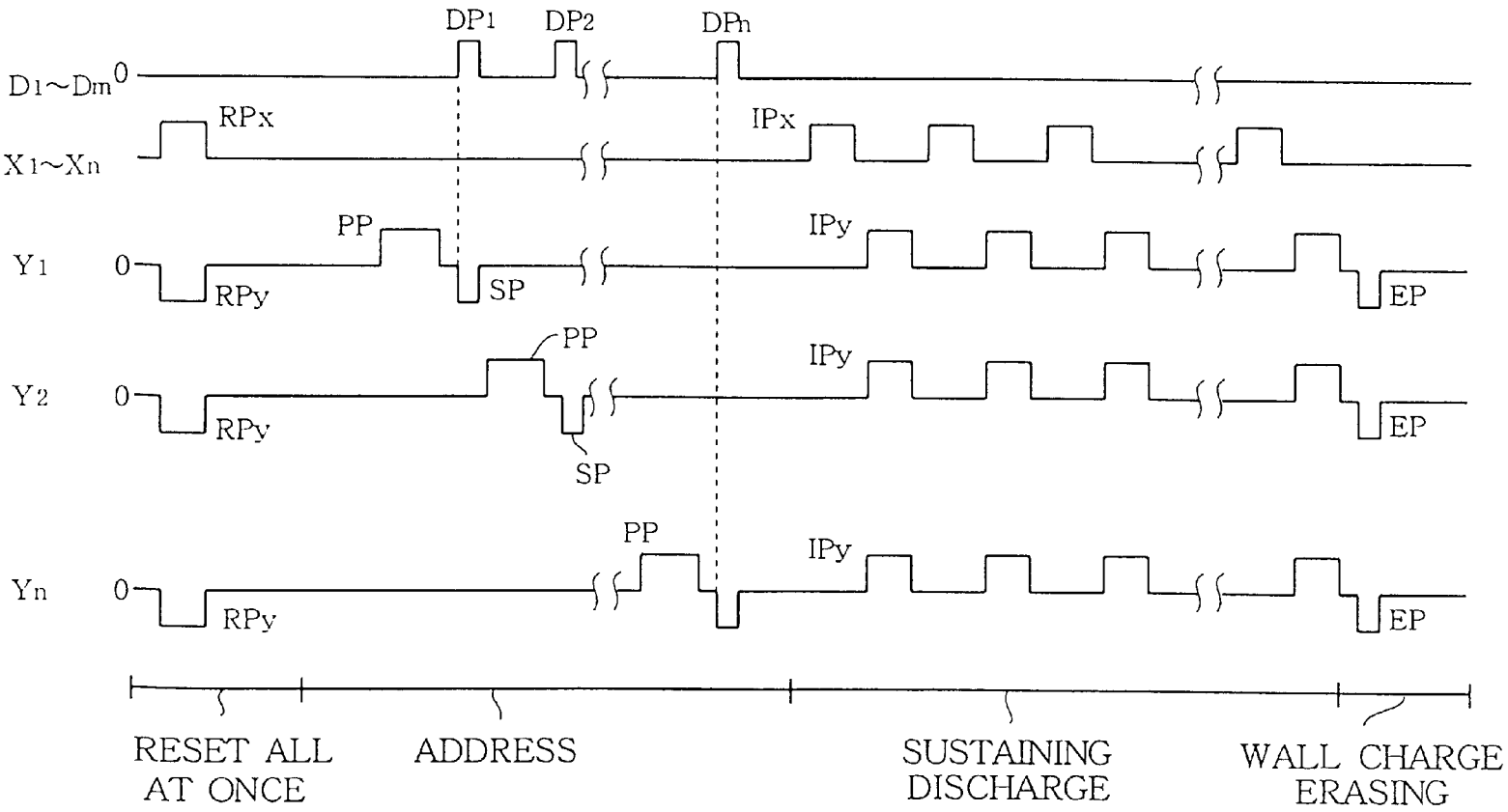
FIG.16 PRIOR ART

The PDP is operated in the same manner as shown in the conventional system of FIG. 16 which has reset period all at once, address period, discharge sustaining period and wall charge erasing period.

Figure 9:
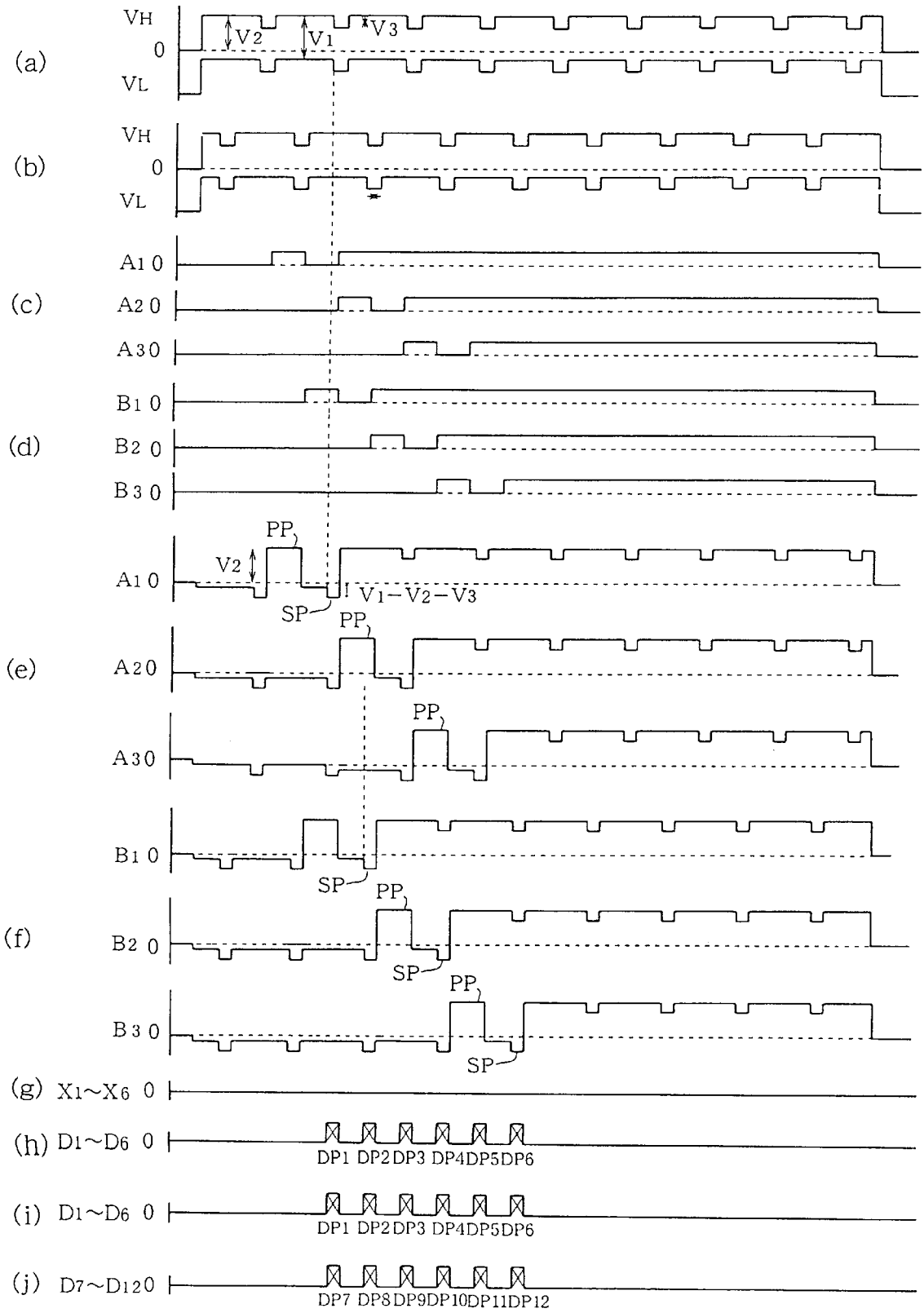

The high and low level terminals of the row electrode driver 32*a* is applied with the offset voltage shown in FIG. 9*a*. The high and low level terminals of the row electrode driver 32*b* is applied with the offset voltage shown in FIG. 9*b*.

When timing pulses A1, A2 and A3 as shown in FIG. 9*c* are applied to the row electrode driver 32*a*, the driver 32*a* produces drive signals A1, A2 and A3 including priming pulse PP and scanning pulse SP as shown in FIG. 9*e* corresponding to the timing signals. The drive signals are applied to the row electrodes Y1, Y3 and Y5. Similarly, when timing pulses B1, B2 and B3 as shown in FIG. 9*d* are applied to the row electrode driver 32*b*, the driver 32*b* applies drive signals B1, B2 and B3 including priming and scanning pulses as shown in FIG. 9*f* to the row electrodes Y2, Y4 and Y6.

As shown in FIG. 9*h*, pixel data pulses DP1–DP6 are applied to the data electrodes D1–D6 corresponding to the scanning pulse SP.

In the fifth embodiment, the Y-row electrodes Y1 to Y6 are divided into two parts for controlling the timing of the added pulse for modulating the offset voltage and the timing signal applied to the row electrode drivers 32*a* and 32*b*. Therefore, the period where the voltage is modulated to V2–V3 is not overlapped with the priming pulse PP, thereby preventing the voltage from dropping at the end of the priming pulse. Furthermore, the sanning pulse applied to one row electrode is produced at a timing to be overlapped with the priming pulse applied to the other row electrode.

Thus, it is possible to stably scan (address) at a high speed.

Namely, in the first embodiment, as shown in FIGS. 3*g* and 3*h*, when the wall charge is produced, the voltage is V2. When the voltage is dropped by the added pulse to V2–V3, it is a waste time because the wall charge is not produced. To the contrary, in the fifth embodiment, there is no period where the voltage is dropped.

In the same manner as the first embodiment, a predetermined voltage is applied to the row electrodes during the address period. The predetermined voltage may be controlled to be gradually returned to the ground potential after the address period.

Figure 10:
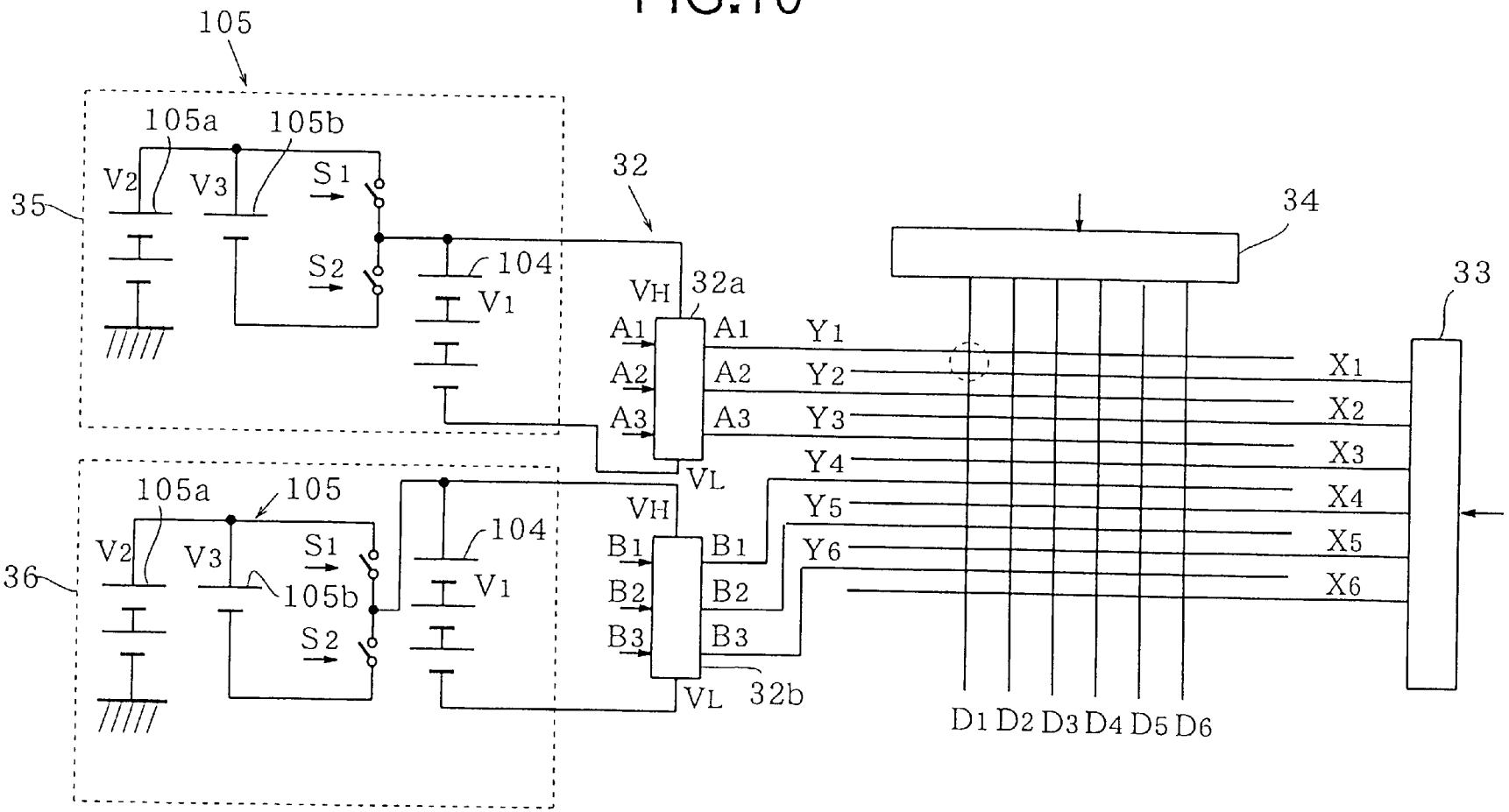

FIG. 10 shows a sixth embodiment where the Y-row electrodes Y1–Y6 are divided into an upper half part of Yl, Y2 and Y3 and a lower half part of Y4, Y5 and Y6. The upper part is connected to the row electrode driver 32*a* and the lower part is connected to the row electrode driver 32*b*.

In operation, the drive signals A1, A2 and A3 of FIG. 9*e* are applied to the row electrodes Y1, Y2 and Y3, and the drive signals B1, B2 and B3 of FIG. 9*f* are applied to the row electrodes Y4, Y5 and Y6. As shown in FIG. 9*i*, pixel data pulses DP1–DP6 are applied to the data electrodes D1–D6 corresponding to the scanning pulse SP.

Figure 11:
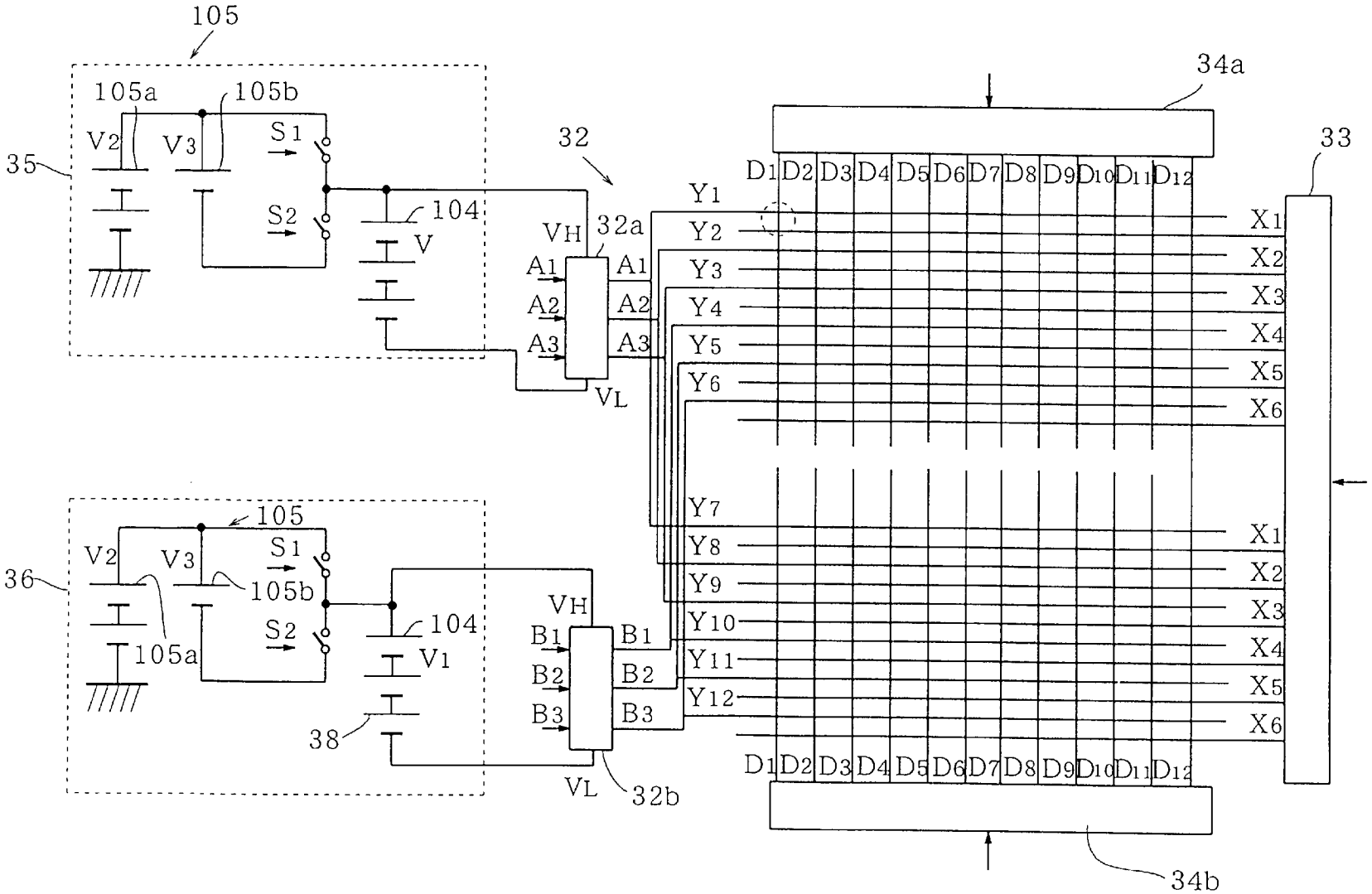

FIG. 11 shows a seventh embodiment. A PDP has Y-row electrodes Y1–Y12, a pair of X-row electrodes X1–X6, and a pair of pixel data electrodes D1–D12. The Y-row electrodes Y1–Y12 are divided into an upper half part of Y1–Y6 and a lower half part of Y7–Y12. In the driving system, the row electrode driver 32*a* is connected to row electrodes Y1–Y3 and Y7–Y9, and the row electrode driver 32*b* is connected to row electrodes Y4–Y6 and Y10–Y12. A pair of pixel data electrode drivers 34*a* and 34*b* are provided for driving the data electrodes D1–D12, respectively.

In operation, the drive signals A1, A2 and A3 of FIG. 9*e* are applied to the row electrodes Y1 (Y7), Y2 (Y8) and Y3 (Y9), and the drive signals B1, B2 and B3 of FIG. 9*f* are applied to the row electrodes Y4 (Y10), Y5 (Y11) and Y6 (Y12).

In the embodiment, a pair of row electrodes in the upper and lower parts are scanned at the same time. Thus, the address period is reduced to the half.

As shown in FIGS. 9*i* and 9*j*, pixel data pulses DP1–DP12 are applied to the respective data electrodes D1–D12 corresponding to the scanning pulse SP.

FIGS. 12*a* to 12*e* show an eighth embodiment in which the driving operation of the fifth embodiment of FIG. 8 is further improved.

Figure 12:
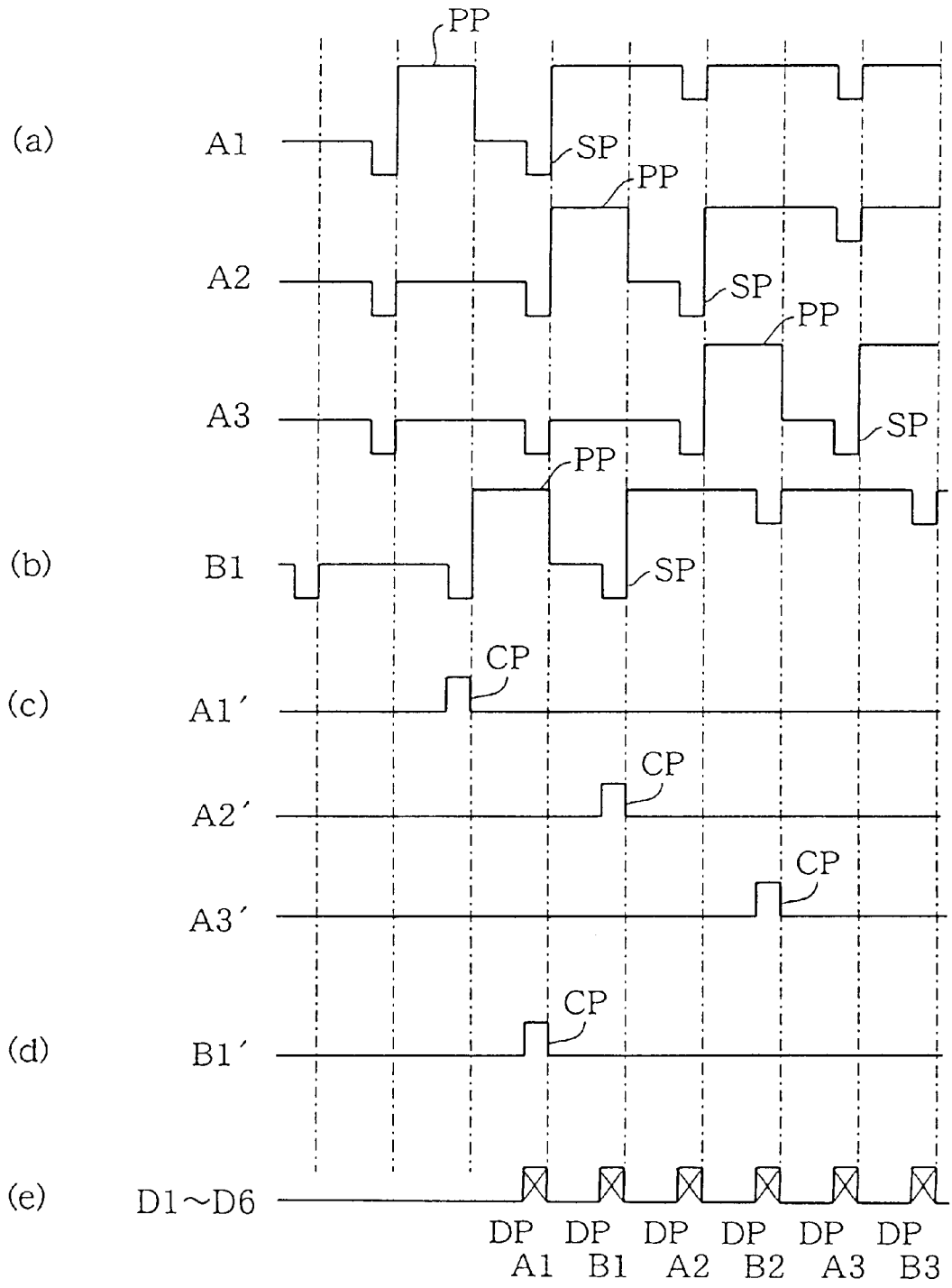

FIG. 12*a* are drive signals A1, A2 and A3 corresponding to drive signals shown in FIG. 9*e* of the fifth embodiment and applied to the row electrodes Y1, Y3 and Y5. FIG. 12*b* is the drive signal B1 applied to the row electrode Y2. As shown in FIG. 12*e*, pixel data pulses DPA1–DPA3 and DPB1–DPB3 are alternately applied to the data electrodes D1–D6 corresponding to the scanning pulse SP.

FIG. 12*c* are drive signals A1', A2' and A3' including canceling pulses CP applied to the X-row electrodes X1, X3 and X5. FIG. 12*d* is a drive signal B1' including canceling pulse CP applied to the X-row electrode X2. Each canceling pulse CP has the same polarity as the data pulse.

In the fifth embodiment, when the first row is scanned for writing, the scanning pulse SP applied to the row electrode Y1 of the first tow (signal A1 of FIG. 9*e*) and the data pulse DP1 applied to the data electrodes D1–D6 are produced at the same timing as the priming pulse PP applied to the row electrode Y2 of the second row (signal B1 of FIG. 9*f*) for producing the selected erasing discharge. Therefore, if priming discharge is performed by the priming pulse PP for the row electrode Y2, negative wall charge is accumulated in the data electrodes D1–D6. As a result, when the scanning pulse SP is applied to the row electrode Y2 and the data pulse DP2 is applied to the data electrode D1–D6 for producing the selected erasing discharge, the selected erasing discharge is difficult to be produced caused by the negative wall charge.

To the contrary, in the embodiment, the canceling pulses CP are applied to the X-row electrodes for stabilizing the selected erasing discharge. Namely, the canceling pulse CP is applied to the X-row electrode X2 which is coupled with the Y-row electrode Y2 at the timing so as to overlap with the scanning pulse SP applied to the row electrode Y1 of the first row (signal A1 of FIG. 12*a*) and the data pulse DPA1 applied to the data electrode D1–D6 (signal DPA1 of FIG. 12*e*). Therefore, if priming discharge is performed by the priming pulse PP for the row electrode Y2 (signal B1 of FIG. 12*b*), positive wall charge is accumulated in the data electrodes D1–D6. Thus, the selected erasing discharge is easily produced.

FIGS. 13*a* to 13*e* show a ninth embodiment in which the X-row electrode driver 33 is not employed with the scanning driver IC.

Figure 13:
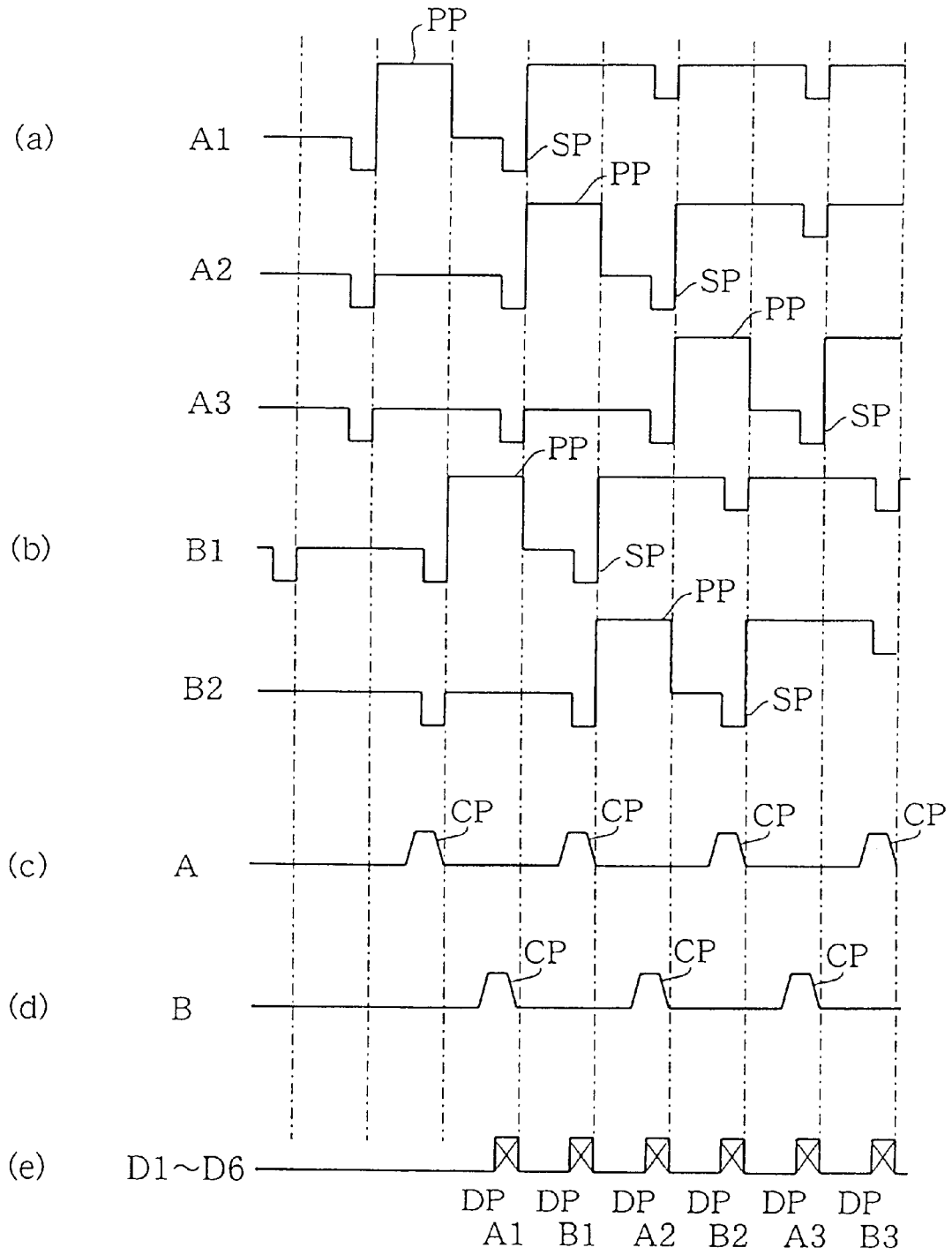
Figure 14:
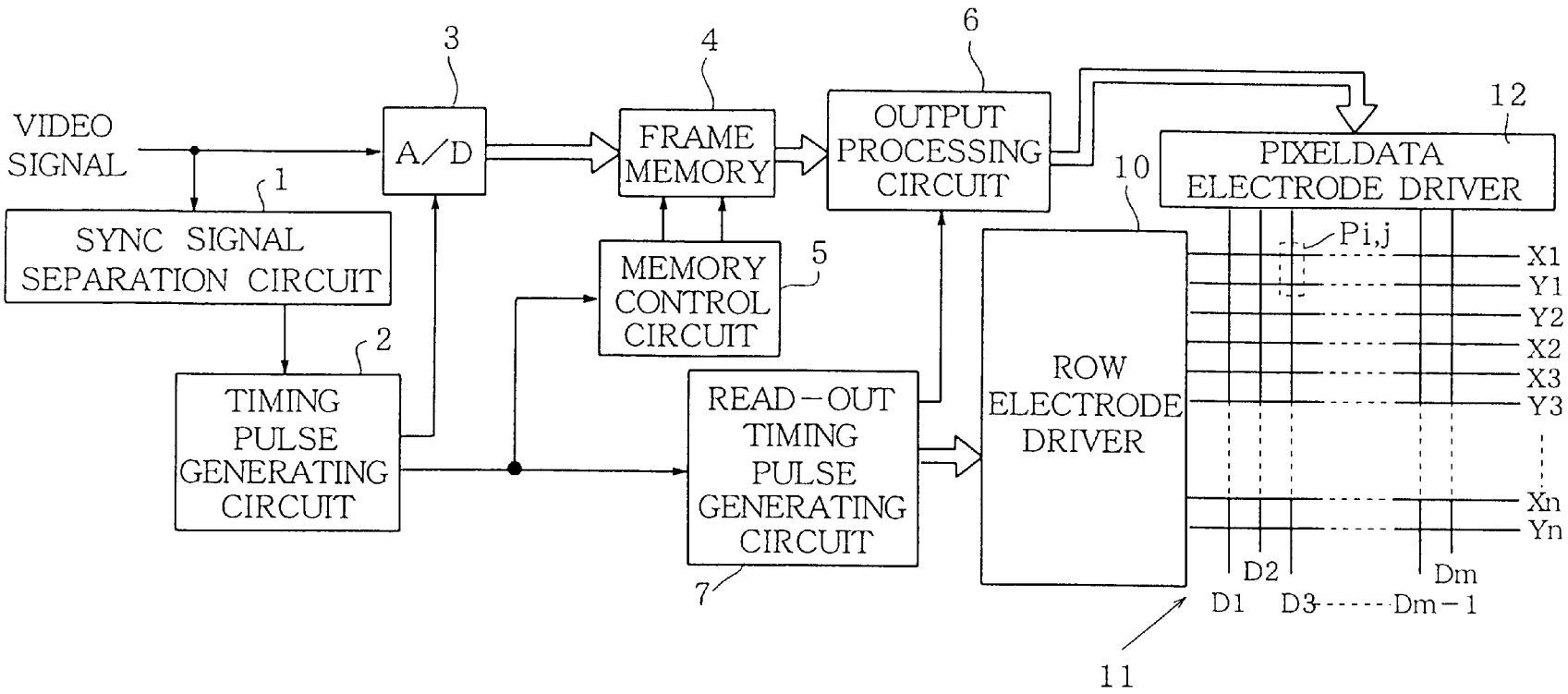
FIG.14 PRIOR ART
Figure 15:
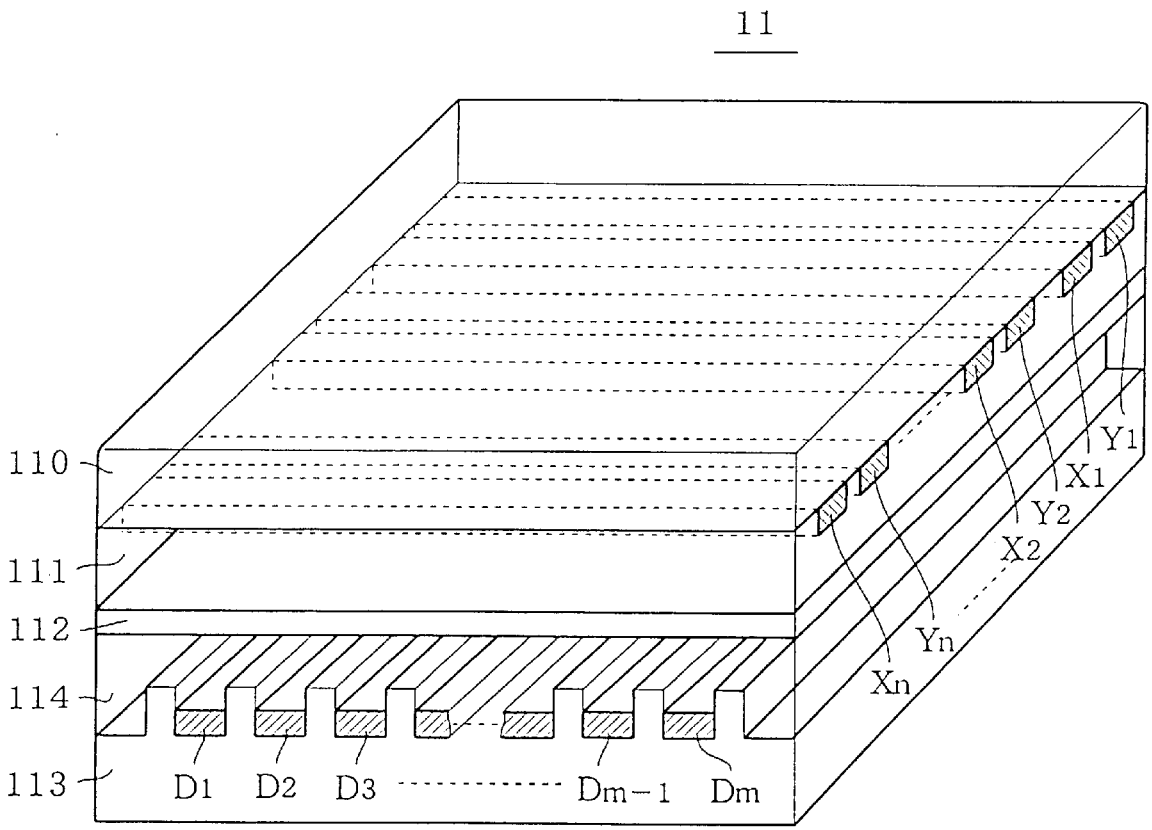
FIG.15 PRIOR ART

FIG. 13*a* are drive signals A1, A2 and A3 applied to the row electrodes Y1, Y3 and Y5. FIG. 13*b* is drive signals B1 and B2 applied to the row electrodes Y2 and Y4. As shown in FIG. 13*e*, pixel data pulses DPA1–DPA3 and DPB1–DPB3 are alternately applied to the data electrodes D1–D6 corresponding to the scanning pulse SP.

FIG. 13*c* is a drive signal A including canceling pulses CP applied to the X-row electrodes X1, X3 and X5 all at once. FIG. 13*d* is a drive signal B including canceling pulses CP applied to the X-row electrodes X2 and X4 all at once. Each canceling pulse CP has the same polarity as the data pulse.

In the embodiment, the selected erasing discharge can be also stabilized.

In accordance with the present invention, it is possible to use the inexpensive all-purpose IC and obtain high definition and quality display without error discharge.

While the invention has been described in conjunction with preferred specific embodiment thereof, it will be understood that this description is intended to illustrate and not limit the scope of the invention, which is defined by the following claims.

What is claimed is:

1. A driving system for a plasma display panel having a plurality of pairs of row electrodes, each pair comprising a first row electrode and a second row electrode, and a plurality of data electrodes which intersect with the row electrodes, the system comprising:

a first row electrode driver having driving circuit means for driving each of the first row electrodes;

a second row electrode driver for driving each of the second row electrodes;

a driving power source for driving the driving circuit means in the first row electrode driver;

an offset voltage applying means for applying an offset voltage to the driving power source so that the first row electrode driver produces a first priming pulse having a first voltage which is applied to the first row electrode;

switching means provided in the first row electrode driver for producing a scanning pulse after the priming pulse having a second voltage different from the first voltage, which is also applied to the first row electrode.

2. The system according to claim 1 wherein the offset voltage applying means has a first power source and a second power source having a supply voltage different from that of the first power source, and switches for changing the offset voltage into two voltages, thereby modulating the offset voltage.

3. The system according to claim 1 wherein the second row electrode driver produces a second priming pulse having an opposite polarity to the first priming pulse produced by the first row electrode driver at the same time as the first priming pulse.

4. The system according to claim 1 wherein the first row electrodes are divided into two groups, the first row electrode driver is arranged such that a period of a scanning pulse for one of the groups is overlapped with a period of a priming pulse for the other group.

5. The system according to claim 4 wherein the first row electrode driver is divided into a first group driver and a second group driver, the driving power source is divided into a first source for driving the first group driver and a second source for driving the second group driver, the offset voltage applying means is divided into a first means for applying a first offset voltage to the first source and a second means for applying a second offset voltage to the second source, each of the first group driver and the second group driver is arranged so as to produce a priming pulse and a scanning pulse having an opposite polarity to the priming pulse.

6. The system according to claim 5 wherein the priming pulse of one of the group drivers does not overlap with the scanning pulse of the other group driver.

7. The system according to claim 5 wherein the data electrodes are divided into two groups.

8. The system according to claim 2 wherein the first row electrode is offset at an opposite polarity to a scanning pulse after finishing of the scanning pulse.

9. The system according to claim 4 wherein a canceling pulse of one of the pairs of the row electrode is applied to a second row electrode of the pair at a same polarity as the priming pulse applied to the first row electrode of the pair at a timing overlapping with the priming pulse.

* * * * *